US006230754B1

(12) United States Patent
Kakuda

(10) Patent No.: US 6,230,754 B1
(45) Date of Patent: May 15, 2001

(54) GROUND WARP LET-OFF TENSION DEVICE OF A CLOTH MOVABLE TYPE TERRY PILE LOOM

(75) Inventor: Hiroshi Kakuda, Kanazawa (JP)

(73) Assignee: Tsudakoma Kogyo Kabushiki Kaisha, Ishikawa-Ken (JP)

( * ) Notice: Subject to any disclaimer, the term of this patent is extended or adjusted under 35 U.S.C. 154(b) by 0 days.

(21) Appl. No.: 09/604,656

(22) Filed: Jun. 27, 2000

(30) Foreign Application Priority Data

Jun. 28, 1999 (JP) ..... 11-181585

(51) Int. Cl.[7] ..... D03D 39/22
(52) U.S. Cl. ..... 139/25
(58) Field of Search ..... 139/25, 26

(56) References Cited

U.S. PATENT DOCUMENTS 3,428,095 * 2/1969 Pfarrwaller ..... 138/25
3,889,719 * 6/1975 Seifert ..... 139/25
5,722,464 * 3/1998 Truyen et al. ..... 139/25

FOREIGN PATENT DOCUMENTS 9-111597 4/1997 (JP) .

* cited by examiner

*Primary Examiner*—Andy Falik
(74) *Attorney, Agent, or Firm*—Wenderoth, Lind & Ponack, L.L.P.

(57) ABSTRACT

A cloth movable type pile loom reduces a load applied to a terry motion mechanism when a ground warp tension roller is moved, and prevents a part associated with the application of tension to the ground warp yarns from being broken in advance. The cloth movable type pile loom includes a pair of first right and left swing levers rotatably supporting the ground warp tension roller, and one of the right and left first swing levers is connected to the terry motion mechanism. A of second right and left swing levers are swingably supported by right and left frames, and are rotatably connected to the first swing levers. A tension application mechanism applies a biasing force to the second swing levers in the turning direction thereof to press ground warp yarns by way of the ground warp tension roller.

18 Claims, 5 Drawing Sheets

GROUND WARP LET-OFF TENSION DEVICE OF A CLOTH MOVABLE TYPE TERRY PILE LOOM

BACKGROUND OF THE INVENTION

1. Field of the Invention

The invention relates to a device for applying tension to ground warp yams in a cloth movable type pile loom by the displacement of a ground warp tension roller.

2. Prior Art

A cloth movable type pile loom is provided with a terry motion mechanism. The terry motion mechanism moves a ground warp tension roller in the same direction as a woven cloth so as to move a cloth fell of a woven cloth back and forth. Accordingly, the terry motion mechanism is associated with a supporting mechanism of a ground warp tension roller to move the ground warp tension roller back and forth. The ground warp tension roller is naturally biased in the direction to apply tension to the ground warp yarns.

FIG. 1 shows a schematic view of a ground warp let-off tension device 1 of a conventional typical cloth movable type pile loom as disclosed in Japanese Patent Laid-Open Publication No. 9-111597. In FIG. 1, ground warp yarns 2 are unwound from a ground warp let-off beam 3, and they contact a ground warp tension roller 4, then they form a shedding 8 by a vertical movement of heddles 5, and finally they reach a cloth fell 7 of a woven cloth 6. Meanwhile, pile warp yarns 9 are unwound from a pile warp let-off beam 10 and contact a pile warp tension roller 11, then they reach the cloth fell 7 of the woven cloth 6. A weft yarn 12 inserted in the position of the shedding 8 is beaten up against the cloth fell 7 by a reed 13 to form the woven cloth 6, then the woven cloth 6 passes through a cloth moving roller 14 and is wound around a cloth winding roller 15.

Since both the cloth moving roller 14 and ground warp tension roller 4 move the woven cloth 6 and ground warp yarns 2 back and forth, they are supported by the terry motion mechanism 16 and a mechanism interlocked therewith. In this example, the terry motion mechanism 16 comprises brackets 18, 19 respectively attached to the right and left frames 17, L-shaped terry motion levers 20, 21 respectively rotatably supported by shafts 23, 24 relative to the brackets 18, 19, and links 22, and shafts 25, 26 for connecting the end portions of the terry motion levers 20, 21.

The terry motion levers 20 are biased clockwise by extension springs 27, and they are supported by a cam 28 and a cam roller 30 that contacts the outer periphery of a cam 28 so as to swing back and forth in synchronization with the rotation of a main shaft 32 of the loom. Meanwhile, the cam 28 is integrated with a camshaft 29 and is driven while interlocked with the rotation of the main shaft 32 of the loom. The cam roller 30 is rotatably supported by the roller shaft 31 of the terry motion levers 20.

The swingable motion of the terry motion levers 20 is transmitted to each one end of a pair of right and left swing levers 36 by way of a shaft 34, interlocking links 33 and a shaft 35. The swing levers 36 are swingably supported by a bracket 37 and a shaft 38 respectively fixed to the frames 17, and they swingably support a pair of right and left levers 41 by an intermediate shaft 39.

The pair of right and left levers 41 are connected to and integrated with each other by a roller shaft 40 serving as a shaft fully extending to the right and left thereof (hereinafter referred to as simply the through shaft) whereby the ground warp tension roller 4 is rotatably supported by the levers 41 at respective first ends while they are biased by an extension spring 42 in the direction to apply tension to the ground warp yarns 2 by way of the ground warp tension roller 4 at respective second ends. When the pair of right and left levers 41 are connected to and integrated with each other, a biasing force of the extension spring 42 acts on the right and left sides of the ground warp tension roller 4 uniformly to the right and left so as to apply a uniform tension to the ground warp yarns 2.

During the weaving operation, the cam 28 is synchronized with the rotation of the main shaft 32 to swing the terry motion levers 20 back and forth. Accordingly, respective terry motion levers 20 move the cloth moving roller 14 back and forth by way of respective links 22 and levers 21 while they move the ground warp tension roller 4 back and forth by way of the respective interlocking links 33 and swing levers 36. As a result, when the ground warp yarns 2 and woven cloth 6 are moved back and forth, the cloth fell 7 is set to a first pick position and a loose pick position corresponding to the weaving texture.

Meanwhile, as looms have lately been operating at higher speeds and becoming large in width, the looms are required to increase in rigidity, so that respective components of the loom become heavy, Accordingly, a load applied to the terry motion mechanism 16 increases so that a breakage in the terry motion 16 mechanism occurs. Further, since the extension spring 42 is repeatedly moved back and forth when the device is moved back and forth, a desired elasticity is not obtained due to the fatigue of the extension spring 42 so that the extension spring 42 has become broken at an early stage. Since the roller shaft 40 of the ground warp tension roller 4 is a through shaft for connecting and integrating the pair of right and left levers 41 with each other, it is heavy so that inertia of the ground warp tension roller 4 becomes large. Accordingly, it is difficult for the ground warp tension roller 4 to move quickly to follow the change of tension of the ground warp yarns 2 so that the tension is kept constant.

SUMMARY OF THE INVENTION

It is an object of the invention to reduce a load to be applied to a terry motion mechanism when a ground warp tension roller is moved in a cloth movable type pile loom, and to prevent parts associated with the application of tension to the ground warp yarns from being broken in advance, and to enhance the response of the ground warp tension roller 4 that follows the change of tension of the ground warp yarns.

To achieve the above object, the cloth movable type pile loom capable of moving a ground warp tension roller back and forth via a terry motion mechanism 16 comprises a pair of first right and left swing levers 43 rotatably supporting the ground warp tension roller 4, at least one of the first right and left swing levers 43 are connected to the terry motion mechanism 16, pair of second right and left swing levers 45 are respectively swingably supported by right and left frames 17 and rotatably connected to the first right and left swing levers 43. A tension application mechanism 48 applies a biasing force to the second right and left swing levers 45 in the turning direction thereof to press ground warp yarns 2 by way of the ground warp tension roller 4.

The second right and left swing levers 45 are connected to and integrated with each other by a connection and integration member, and the second right and left swing levers 45 are swingably supported by the right and left frames 17 by way of a fulcrum shaft 46 which constitutes the connection and integration member.

The tension application mechanism 48 can be formed of an extension spring 49 for passively applying the biasing force to the second swing levers 45 in the turning direction thereof by elasticity of the extension spring 49. The tension application mechanism 48 can also comprise motion conversion mechanisms (53, 54, 55, 56, 57), are synchronized with the rotation of a main shaft 32 of the loom to positively apply a reciprocation motion to the second swing levers 45.

According to the invention, the second swing levers swingably support the first swing levers which are driven by the terry motion mechanism, however, the second swing levers, the second shaft serving as the fulcrum shaft of the second swing levers, and the first shaft for connecting between the first and second swing levers are not driven by the terry motion mechanism. Further, since the pair of first right and left swing levers need not be connected and integrated to each other, the roller shaft and the shaft 35 need not be formed of a through shaft, and the terry motion mechanism need not drive a heavy through shaft. Accordingly, the invention can reduce the load applied to the terry motion mechanism and prevent the terry motion mechanism from being broken in advance due to increased load, compared with the prior art. Still further, if the second shaft serving as the fulcrum shaft is formed of a through shaft and the pair of second right and left swing levers are connected to and integrated with each other, the first shaft need not be formed of a through shaft. Accordingly, a member to be swung by the tension spring can dispense with a heavy through shaft to reduce inertia. If the tension application mechanism is formed of a spring, the spring allows the ground warp tension load to quickly respond to the change of tension of the ground warp yarns to follow them. Still further, since the second swing levers are not moved back and forth, the spring is not deformed back and forth to thereby solve the problem of fatigue caused by the deformation and thus reduce breakage of the spring. Even if the tension application mechanism is formed of an easing mechanism, it is possible to achieve easy motion that is accurately synchronized with the rotation of the main shaft, because the second swing levers do not move back and forth.

PREFERRED EMBODIMENT OF THE INVENTION

Figure 1:
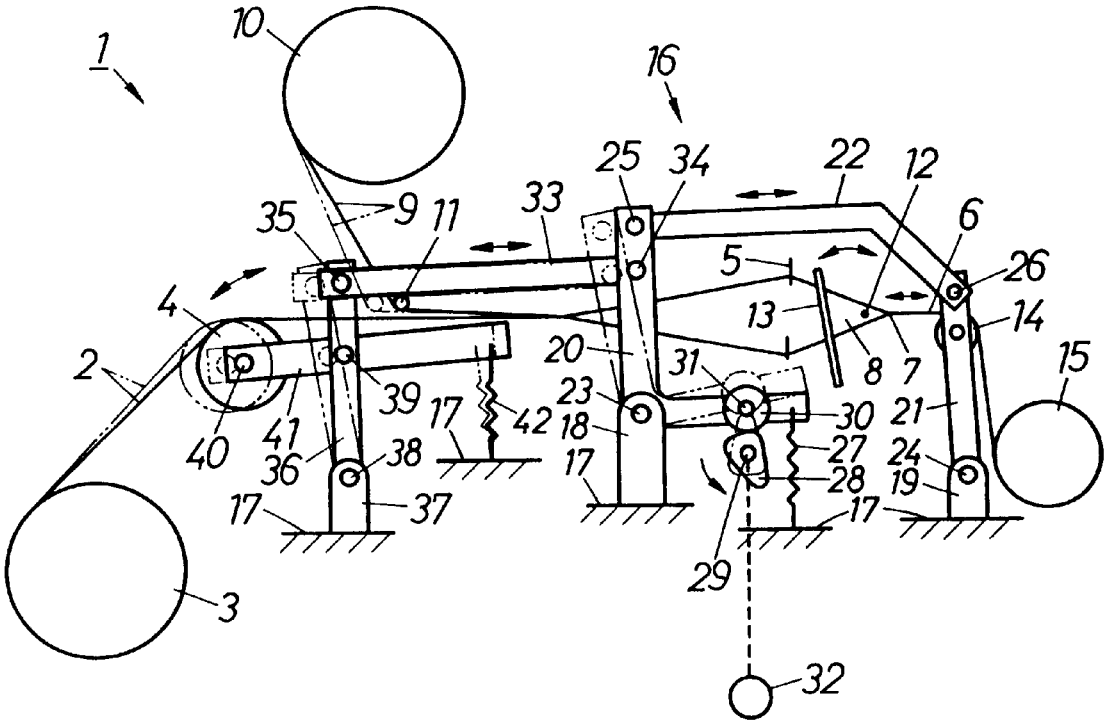
FIG.1 (PRIOR ART)
FIG. 1 is a side view of a conventional ground warp let-off tension device of a cloth movable type pile loom.
Figure 2:
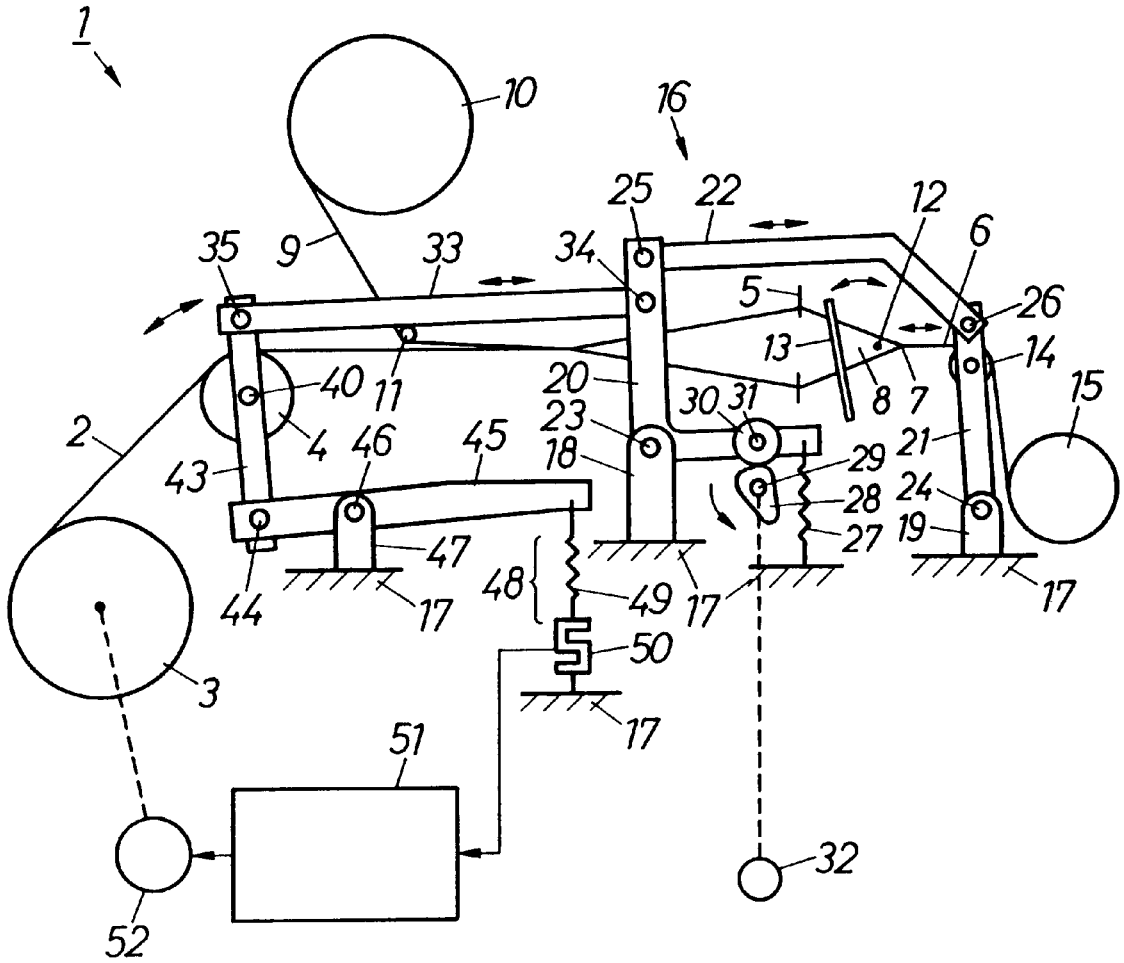
FIG. 2 is a side view of a ground warp let-off tension device of a cloth movable type pile loom according to a first embodiment of the invention wherein a cloth is moved forward.
Figure 3:
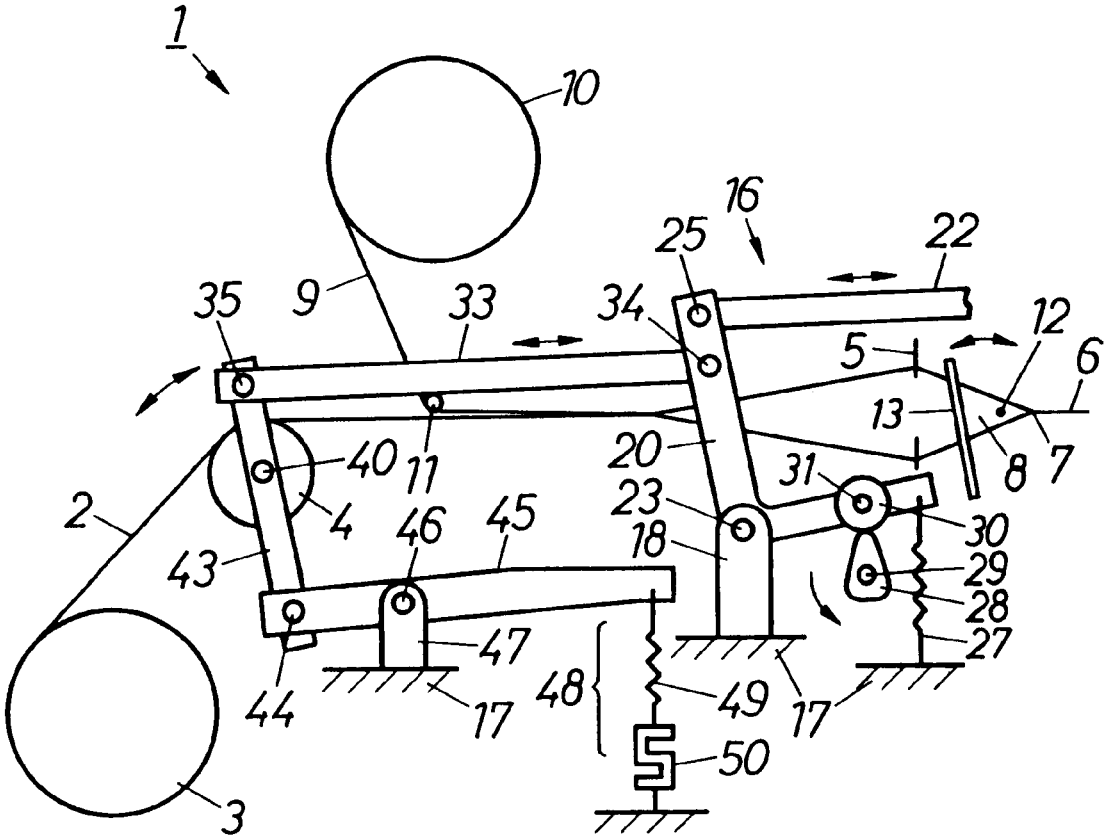
FIG. 3 is a side view of a ground warp let-off tension device of a cloth movable type pile loom according to the first embodiment of the invention wherein the cloth is retracted.

First Embodiment [FIGS. 2 and 3]

A ground warp let-off tension device 1 of a cloth movable type pile loom according to a first embodiment of the invention is first described with reference to FIGS. 2 and 3. A part of the configuration of the first embodiment is the same as that of the conventional one, and hence the same components of the invention as those of the prior art are denoted by the same reference numerals.

In FIGS. 2 and 3, ground warp yarns 2 are unwound from a ground warp let-off beam 3, and contact a ground warp tension roller 4, then they form a shedding 8 by a vertical movement of heddles 5, and finally they reach a cloth fell 7 of a woven cloth 6. Meanwhile, pile warp yarns 9 are unwound from a pile warp let-off beam 10 and contacts a pile warp tension roller 11, and then they reach the cloth fell 7 of the woven cloth 6. A weft yarn 12 inserted inside the shedding 8 in the position of the shedding 8 is beaten up against the cloth fell 7 by a reed 13, and it forms the woven cloth 6, and then the woven cloth 6 passes through a cloth moving roller 14 and is wound around a cloth winding roller 15.

Since both the cloth moving roller 14 and ground warp tension roller 4 move the woven cloth 6 and ground warp yams 2 back and forth, they are supported by the terry motion mechanism 16 and a mechanism interlocked therewith. In the first embodiment, the terry motion 16 comprises brackets 18, 19 respectively attached to the right and left frames 17, L-shaped terry motion levers 20, 21 respectively rotatably supported by shafts 23, 24 relative to the brackets 18, 19, links 22, and shafts 25, 26 respectively connecting the free ends of the terry motion levers 20, 21.

The terry motion levers 20 are biased clockwise by extension springs 27, and they are supported by a cam 28 and a cam roller 30 that contacts the outer periphery of the cam 28 so as to swing back and forth in synchronization with the rotation of a main shaft 32 of the loom. Meanwhile, the cam 28 is integrated with a camshaft 29 and is driven while interlocked with the rotation of the main shaft 32 of the loom. The cam roller 30 is rotatably supported by the roller shaft 31 of the terry motion levers 20.

The swingable motion of the terry motion levers 20 is transmitted to respective first ends of a pair of first right and left swing levers 43 by way of a pair of right and left interlocking links 33 and a shaft 35. The first swing levers 43 rotatably support the ground warp tension roller 4 by the intermediate roller shaft 40, and connected to respective first ends of respective second ends of the first swing levers 43 are a pair of second right and left swing levers 45 by a first shaft 44.

The pair of second right and left swing levers 45 are swingably supported by a second shaft 46 serving as a fulcrum shaft relative to a bracket 47 fixed to the right and left frames 17, and they are connected to and integrated with each other by the second shaft 46 serving as a connection and integration member, and they are also engaged with the right and left frames 17 by an extension spring 49 serving as a tension application mechanism 48. Since the second right and left swing levers 45 are connected to and integrated with each other at the right and left, the biasing force of the extension spring 49 equally acts on the second right and left swing levers 45.

Since the first shaft 44 is sufficient to operate as the swinging center of the first swing levers 43 while the roller shaft 40 is sufficient to operate as the rotating center of the ground warp tension roller 4, both the roller shaft 40 and first shaft 44 dispense with a through shaft extending to the right and left thereof and forming a heavy item. According to the first embodiment, two first shafts 44 are provided separately at the right and left, namely, at the side of the respective right and left levers 45 to lighten them as much as possible.

Accordingly, it is possible to reduce inertia which prevents the ground warp tension roller 4 from moving in response to the change of tension of the ground warp yarns 2, so that the ground warp tension roller 4 can respond quickly to keep tension of the ground warp yarns constant.

In the case that one of the interlocking links 33 is provided only at one of the right and left sides and it is connected to one of the first swing levers 43, either of the roller shaft 40, first shaft 44 and shaft 35 is formed of a through shaft, and the pair of first right and left swing levers 43 need to be connected to and integrated with each other. In this case, if the first shaft 44 is formed of a through shaft, it is advantageous that a load applied to the terry motion mechanism 16 is reduced. The first shaft 44 may be used as the connection and integration member of the second right and left swing levers 45 instead of the second shaft 46. In the latter case, although the characteristic of the ground warp tension roller 4 following the change of tension of the ground warp yarns 2 is degraded, the effect for reducing a load applied to the terry motion mechanism 16 is equal.

A tension detector 50 such as a load cell is interposed in the end of the extension spring 49. The tension detector 50 indirectly measures tension of the ground warp yarns 2 from stress of the extension spring 49 and sends out a signal proportional to tension of the ground warp yarns 2 to a let-off motion controller 51. The let-off motion controller 51 adjusts a rotating speed of a let-off motor 52 on the basis of the difference between a target tension of the ground warp yarns 2 and the detected tension, and then it rotates the ground warp let-off beam 3 in the let-off or unwinding direction so as to unwind the ground warp yarns 2 while keeping the ground warp yarns 2 at the target tension.

The terry motion mechanism 16 moves the woven cloth 6, the cloth fell 7 thereof and the ground warp tension roller 4 backward, i.e., in the direction of the ground warp let-off beam 3 immediately before beating up for forming the pile, as shown in FIG. 3, while moving them in the opposite direction after beating up for forming a pile, and then the woven cloth 6, the cloth fell 7 thereof and the ground warp tension roller 4 are returned to the original positions as shown in FIG. 2. The first swing levers 43 swing about the first shaft 44 while the ground warp tension roller 4 moves back and forth.

Accordingly, the second right and left swing levers 45 are not directly driven by the swinging motion of the first swing levers 43 while the first swing levers 43 swing back and forth so they do not respond to the back and forth motion of the terry motion mechanism 16. As a result, the extension spring 49 of the tension application mechanism 48 is not interlocked with the motion mechanism of the terry motion 16 but passively responds only to the change of tension of the ground warp yarns 2 to push the ground warp yarns 2 in the extension direction by way of the ground warp tension roller 4 so as to apply necessary tension to the ground warp yarns 2. When the ground warp yarns 2 are consumed to increase tension thereof, the let-off motion controller 51 increases the rotating speed of the let-off motor 52 to unwind the ground warp yarns 2 per unit of time so as to allow the tension to approach a target tension

Figure 4:
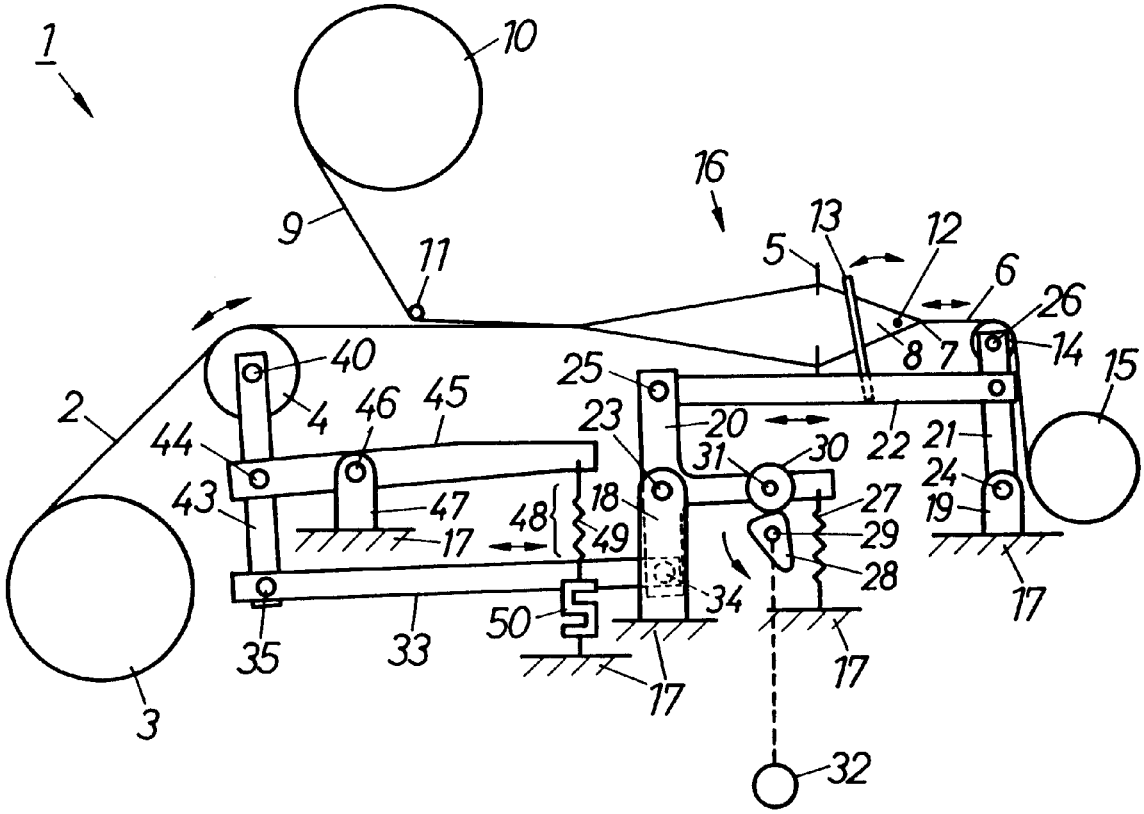
FIG. 4 is a side view of a ground warp let-off tension device of a cloth movable type pile loom according to a second embodiment.

Second Embodiment [FIG. 4]

A ground warp let-off tension device of a cloth movable type pile loom according to a second embodiment of the invention is described with reference to FIG. 4.

In the second embodiment, interlocking links 33 are positioned downward relative to the second swing levers 45. The interlocking links 33 connect between the lower ends of terry motion levers 20 and first swing levers 43. Accordingly, the terry motion levers 20 are formed of respectively T-shaped levers.

Figure 5:
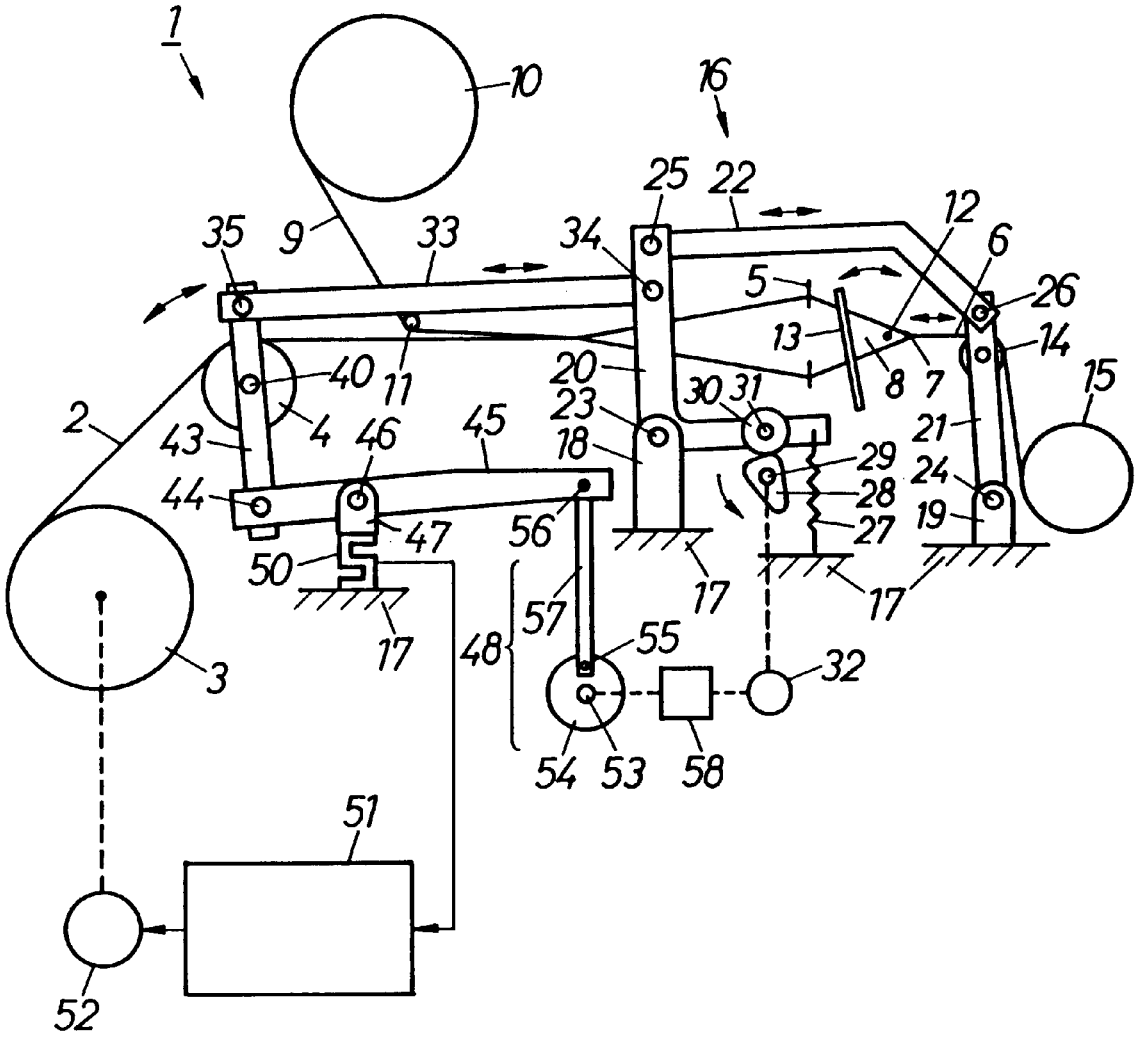
FIG. 5 is a side view of a ground warp let-off tension device of a cloth movable type pile loom according to a third embodiment.

Third Embodiment [FIG. 5]

A ground warp let-off tension device of a cloth movable type pile loom according to a third embodiment of the invention is described with reference to FIG. 5

In FIG. 5, a tension detector 50 such as a load cell is not fixed to the extension spring 49 as in the first embodiment but is rather fixed to a bracket 47, and serves as a connection and integration member of a pair of second right and left swing levers 45. The tension detector 50 indirectly measures tension of the ground warp yarns 2 from a load applied to a second shaft 46 serving as a fulcrum shaft. A tension application mechanism 48 comprises, instead of the extension spring 49 of the first embodiment shown in FIGS. 2 and 3, an easing shaft 53 that is interlocked with the rotation of a main shaft 32, a wheel 54 integrated with the easing shaft 53, an eccentric pin 55 attached to the wheel 54, and rods 57 for connecting between the eccentric pin 55 and a pin 56 of the second swing levers 45.

Since the rotation of the main shaft 32 is transmitted to the wheel 54 by way of reduction gears or speed change gears 58, an orbital motion of the eccentric pin 55 rotating about the easing shaft 53 is changed to a reciprocal motion and is transmitted to the second swing levers 45. As a result, the second swing levers 45 positively move the position of the ground warp tension roller 4 in synchronization with the rotation of the main shaft 32 to displace the ground warp tension roller 4 in the direction to loosen tension of the ground warp yarns 2 when forming the shedding 8, or they move the ground warp tension roller 4 in the direction to tighten the ground warp yarns 2 when closing the shedding 8, thereby maintaining a closing condition of the shedding 8.

In such a manner, the tension application mechanism 48 positively adjusts the pressing of the ground warp yarns 2 to set tension of the ground warp yarns 2 to the optimum value in accordance with the angle of rotation of the main shaft 32. The tension application mechanism 48 shown in FIG. 5 is a so-called positive easing mechanism by a motion changing mechanism constituted for changing the rotating motion and reciprocating motion, and it may be configured by the other known motion changing mechanism. On the other hand, the tension application means 48 formed of the extension spring 49 as shown in FIGS. 2, 3 and 4 is a so-called passive easing mechanism.

Although the terry motion mechanism 16 is described as a premise according to the invention, the configuration of the terry motion mechanism 16 is not limited to those as illustrated in FIGS. 2 to 5 but may be configured by other known mechanisms, e.g., a combination of a crank mechanism and a link mechanism. Further, the terry motion mechanism 16 may be provided with the pile warp tension roller 11 which moves back and forth like the ground warp tension roller 4.

What is claimed is:

1. A cloth movable type pile loom including a ground warp let-off tension device for moving a ground warp tension roller back and forth via a terry motion mechanism, said ground warp let-off tension device comprising:

a pair of first right and left swing levers for rotatably supporting the ground warp tension roller, at least one of said right and left swing levers being adapted for connection to the terry motion mechanism;

a pair of second right and left swing levers respectively swingably supported by right and left frames and rotatably connected to said first right and left swing levers; and a tension application mechanism for applying a biasing force to said second right and left swing levers in a turning direction thereof to press a ground warp by way of the ground warp tension roller.

2. The pile loom and ground warp let-off tension device according to claim 1, wherein said second right and left swing levers are connected to and integrated with each other by a connection and integration member.

3. The pile loom and ground warp let-off tension device according to claim 2, wherein said tension application mechanism comprises a spring for passively applying the biasing force to said second right and left swing levers in the turning direction thereof by elasticity of the spring.

4. The pile loom and ground warp let-off tension device according to claim 2, wherein said tension application mechanism comprises motion conversion mechanisms adapted to be synchronized with the rotation of a main shaft of the loom to positively apply a reciprocation motion to said second right and left swing levers.

5. The pile loom and ground warp let-off tension device according to claim 1, wherein said second right and left swing levers are swingably supported by the right and left frames by way of a fulcrum shaft which constitutes a connection and integration member that connects and integrates said second right and left swing levers.

6. The pile loom and ground warp let-off tension device according to claim 5, wherein said tension application mechanism comprises a spring for passively applying the biasing force to said second right and left swing levers in the turning direction thereof by elasticity of the spring.

7. The pile loom and ground warp let-off tension device according to claim 5, wherein said tension application mechanism comprises motion conversion mechanisms adapted to be synchronized with the rotation of a main shaft of the loom to positively apply a reciprocation motion to said second right and left swing levers.

8. The pile loom and ground warp let-off tension device according to claim 1, wherein said tension application mechanism comprises a spring for passively applying the biasing force to said second right and left swing levers in the turning direction thereof by elasticity of the spring.

9. The pile loom and ground warp let-off tension device according to claim 1, wherein said tension application mechanism comprises motion conversion mechanisms adapted to be synchronized with the rotation of a main shaft of the loom to positively apply a reciprocation motion to said second right and left swing levers.

10. A ground warp let-off tension device for a cloth movable type pile loom capable of moving a ground warp tension roller back and forth via a terry motion mechanism, said ground warp let-off tension device comprising:

a pair of first right and left swing levers for rotatably supporting the ground warp tension roller, at least one of said right and left swing levers being adapted for connection to the terry motion mechanism;

a pair of second right and left swing levers respectively swingably supported by right and left frames and rotatably connected to said first right and left swing levers; and a tension application mechanism for applying a biasing force to said second right and left swing levers in a turning direction thereof to press a ground warp by way of the ground warp tension roller.

11. The ground warp let-off tension device according to claim 10, wherein said second right and left swing levers are connected to and integrated with each other by a connection and integration member.

12. The ground warp let-off tension device according to claim 11, wherein said tension application mechanism comprises a spring for passively applying the biasing force to said second right and left swing levers in the turning direction thereof by elasticity of the spring.

13. The ground warp let-off tension device according to claim 11, wherein said tension application mechanism comprises motion conversion mechanisms adapted to be synchronized with the rotation of a main shaft of the loom to positively apply a reciprocation motion to said second right and left swing levers.

14. The ground warp let-off tension device according to claim 10, wherein said second right and left swing levers are swingably supported by the right and left frames by way of a fulcrum shaft which constitutes a connection and integration member that connects and integrates said second right and left swing levers.

15. The ground warp let-off tension device according to claim 14, wherein said tension application mechanism comprises a spring for passively applying the biasing force to said second right and left swing levers in the turning direction thereof by elasticity of the spring.

16. The ground warp let-off tension device according to claim 14, wherein said tension application mechanism comprises motion conversion mechanisms adapted to be synchronized with the rotation of a main shaft of the loom to positively apply a reciprocation motion to said second right and left swing levers.

17. The ground warp let-off tension device according to claim 10, wherein said tension application mechanism comprises a spring for passively applying the biasing force to said second right and left swing levers in the turning direction thereof by elasticity of the spring.

18. The ground warp let-off tension device according to claim 10, wherein said tension application mechanism comprises motion conversion mechanisms adapted to be synchronized with the rotation of a main shaft of the loom to positively apply a reciprocation motion to said second right and left swing levers.

* * * * *